US007831164B2

(12) United States Patent
Barton

(10) Patent No.: US 7,831,164 B2
(45) Date of Patent: Nov. 9, 2010

(54) FUSER WITH GLOSS FEEDBACK CONTROL

(75) Inventor: Augusto E. Barton, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 3 days.

(21) Appl. No.: 12/052,767

(22) Filed: Mar. 21, 2008

(65) Prior Publication Data

US 2009/0238594 A1 Sep. 24, 2009

(51) Int. Cl.
*G03G 15/20* (2006.01)

(52) U.S. Cl. ..... 399/69; 399/341; 399/67

(58) Field of Classification Search ..... 399/67, 399/69.32

See application file for complete search history.

(56) References Cited

U.S. PATENT DOCUMENTS

| | | | | |
|---|---|---|---|---|
| 4,579,446 | A | 4/1986 | Fujino et al. | |
| 4,587,532 | A | 5/1986 | Asano | |
| 5,489,969 | A | 2/1996 | Soler et al. | |
| 5,568,246 | A | 10/1996 | Keller et al. | |
| 5,570,172 | A | 10/1996 | Acquaviva | |
| 5,596,416 | A | 1/1997 | Barry et al. | |
| 5,678,133 | A | 10/1997 | Siegel | |
| 5,748,221 | A | 5/1998 | Castelli et al. | |
| 5,839,016 | A | 11/1998 | Folkins et al. | |
| 5,995,721 | A | 11/1999 | Rourke et al. | |
| 6,085,050 | A | 7/2000 | Rowe et al. | |
| 6,101,345 | A | 8/2000 | Van Goethem et al. | |
| 6,125,248 | A * | 9/2000 | Moser | 399/68 |
| 6,389,241 | B1 | 5/2002 | Cernusak et al. | |
| 6,554,276 | B2 | 4/2003 | Jackson et al. | |
| 6,607,320 | B2 | 8/2003 | Bobrow et al. | |
| 6,654,136 | B2 | 11/2003 | Shimada | |
| 2005/0058466 | A1 * | 3/2005 | Toyohara | 399/45 |
| 2006/0115306 | A1 * | 6/2006 | Lofthus et al. | 399/341 |
| 2006/0221362 | A1 * | 10/2006 | Julien | 358/1.4 |
| 2007/0140751 | A1 | 6/2007 | Eun et al. | |
| 2008/0245979 | A1 | 10/2008 | Banton et al. | |

OTHER PUBLICATIONS

Zehntner GMBH Testing Instruments, On-Line-Glanzmess-System, On-Line-Gloss Measuring System.

* cited by examiner

*Primary Examiner*—David M Gray
*Assistant Examiner*—Roy Yi
(74) *Attorney, Agent, or Firm*—Fay Sharpe LLP

(57) ABSTRACT

A method of controlling gloss in a printing system having a fuser. The method includes: creating a gloss look-up table for temperature settings; using the look-up table for temperature settings to determine a desired gloss range; measuring an actual gloss range on a substrate continuously with an in-line gloss meter; and determining whether the actual gloss range is within the desired gloss range. Where the actual gloss range is outside the desired gloss range, the temperature settings of the fuser are adjusted.

20 Claims, 7 Drawing Sheets

FUSER WITH GLOSS FEEDBACK CONTROL

BACKGROUND

The exemplary embodiments disclosed herein relate to a method and system for fusing prints with gloss feedback control. While the exemplary embodiment is particularly directed to the art of electrophotographic marking, and will be thus described with specific reference thereto, it will be appreciated that the exemplary embodiment may have usefulness in other fields and applications.

By way of background, electrophotographic marking is a well known and commonly used method of copying or printing documents. Electrophotographic marking is performed by exposing a light image representation of a desired document onto a substantially uniformly charged photoreceptor. In response to that light image the photoreceptor discharges so as to create an electrostatic latent image of the desired document on the photoreceptor's surface. Toner particles are then deposited onto that latent image so as to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image.

Gloss is the property of a substrate surface which involves specular reflection. Specular reflection is a sharply defined light beam resulting from reflection off a smooth, uniform surface. Gloss follows the law of reflection which states that when a ray of light reflects off a surface, the angle of incidence is equal to the angle of reflection. Gloss properties are generally measured in Gardner Gloss Units (ggu) by a gloss meter.

Gloss acceptability levels for copies and prints are dependent on the market segment involved. Some customers like glossy prints (e.g., above 90 ggu) while some customers prefer a more matte look (e.g., below 60ggu), and some customers like the image gloss to match the paper gloss. Gloss levels are currently set by using media libraries that set the fuser temperature via a look-up table to try to match a gloss level or range. The performance with the current approach is limited in that the gloss still varies due to various factors, including paper properties, toner properties and toner mass per unit area (TMA), oil levels, fuser roll age, and temperature variability.

Thus, the exemplary embodiments contemplate a new and improved method (and system) that resolves the above-referenced difficulties and others.

BRIEF DESCRIPTION

In one embodiment, a method of controlling gloss in a printing system having a fuser is provided. The method comprises: creating a gloss look-up table for temperature settings; using the look-up table for temperature settings to determine a desired gloss range; measuring an actual gloss range on a substrate continuously with an in-line gloss meter; determining whether the actual gloss range is within the desired gloss range; and where the actual gloss range is outside the desired gloss range, adjusting temperature settings of the fuser.

In another embodiment, a printing system is provided. The printing system comprises: a user interface for operating the printing system; at least one print engine; a fuser having a plurality of temperature settings; a digital front end controller for controlling the operation of the printing system; and an in-line gloss meter providing feedback to the controller. Further, the digital front end controller is operative to: create a gloss look-up table for temperature settings; use the look-up table for temperature settings to determine a desired gloss range; receive gloss range data from the in-line gloss meter; determine whether the actual gloss range is within the desired gloss range; and adjust the temperature settings of the fuser where the actual gloss range is outside the desired gloss range.

DETAILED DESCRIPTION

Figure 1:
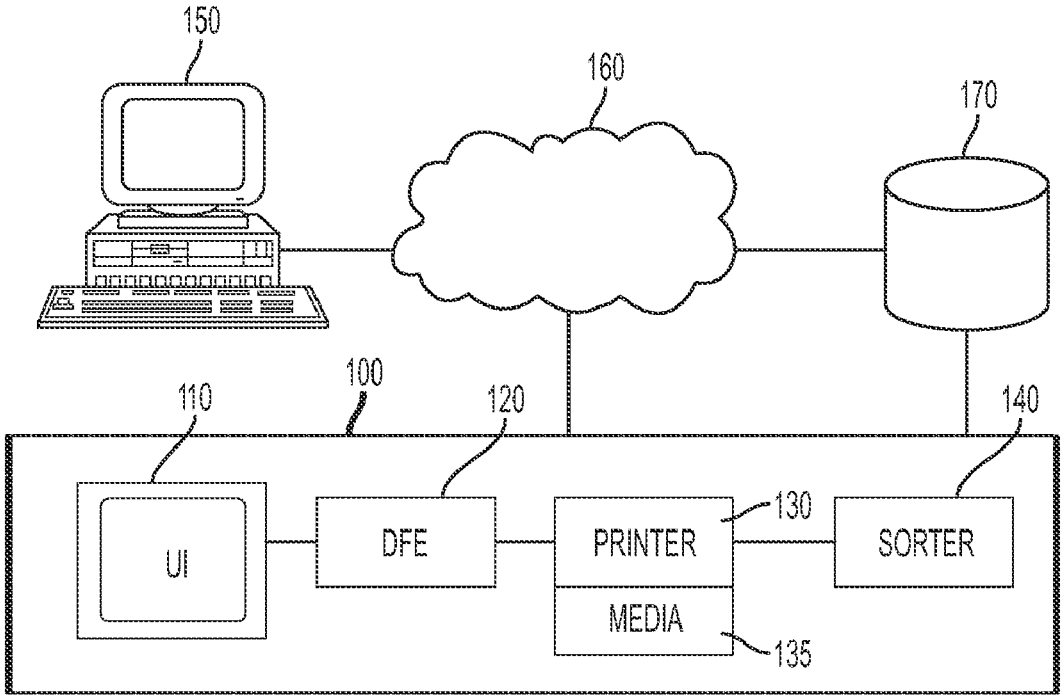
FIG. 1 is a block diagram of printing system suitable for implementing aspects of the exemplary embodiment.

Some portions of the description below are presented in terms of algorithms and symbolic representations of operations on data bits performed by conventional computer components, including a central processing unit (CPU), memory storage devices for the CPU, and connected display devices. These algorithmic descriptions and representations are the means used by those skilled in the data processing arts to most effectively convey the substance of their work to others skilled in the art. An algorithm is generally perceived as a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be understood, however, that all of these and similar terms are to be associated with the appropriate physical quantities and are merely convenient labels applied to these quantities. Unless specifically stated otherwise as apparent from the preceding discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The algorithms and displays presented herein are not inherently related to any particular computer or other apparatus. Various general-purpose systems may be used with programs in accordance with the teachings herein, or it may prove convenient to construct more specialized apparatus to per-form the methods described herein. The structure for a variety of these systems will be apparent from the description. In addition, the present exemplary embodiment is not described with reference to any particular programming language. It will be appreciated that a variety of programming languages may be used to implement the teachings of the exemplary embodiment as described herein.

A machine-readable medium includes any mechanism for storing or transmitting information in a form readable by a machine (e.g., a computer). For instance, a machine-readable medium includes read only memory ("ROM"); random access memory ("RAM"); magnetic disk storage media; optical storage media; flash memory devices; electrical, optical, acoustical or other form of propagated signals (e.g., carrier waves, infrared signals, digital signals, etc.); etc.

Aspects of the embodiments disclosed herein relate to a xerographic printing system that facilitates custom color printing as well as printing with primary colors (CMYK). The printing system includes a plurality of print engines, which may be linked by a common network of pathways connecting the print engines with each other and with an output destination. The print engines may all be under the control of a common control system for printing images from a common print job stream. The printing system can have a modular architecture that allows one or more print engines to be interchanged with other print engines. The printing system enables custom color, and process color and/or black and white printing on the same sheet in a single printing system.

The term "print engine" refers to a device for applying an image to print media. Print media generally refers to a usually flimsy physical sheet of paper, plastic, or other suitable physical print media substrate for images, whether precut or web fed.

A "print job" is normally a set of related sheets, usually one or more collated copy sets copied from a set of original document sheets or electronic document page images, from a particular user, or which are otherwise related.

With reference now to FIG. 1, a printing system (or image rendering system) 100 suitable for implementing aspects of the exemplary embodiments is illustrated. The printing system 100 generally includes a user interface 110, a digital front end (DFE) controller 120, and at least one print engine 130. The print engine 130 has access to media 135 of various sizes and cost for a print job. A "print job" or "document" is normally a set of related sheets, usually one or more collated copy sets copied from a set of original print job sheets or electronic document page images, from a particular user, or otherwise related. For submission of a regular print job (or customer job), digital data is generally sent to the printing system 100. A sorter 140 operates after a job is printed by the print engine 130 to manage arrangement of the hard copy output, including cutting functions. A user can access and operate the printing system 100 using the user interface 110 or via a workstation 150. The workstation 150 communicates with the printing system 100 via a communications network 160. A user profile, a work product for printing, a media library, and various print job parameters can be stored in a database or memory 170 accessible by the workstation 150 or the printing system 100 via the network 160, or such data can be directly accessed via the printing system 100. One or more color sensors (not shown) may be embedded in the printer paper path, as known in the art.

The printing system 100 may incorporate "tandem engine" printers, "parallel" printers, "cluster printing," "output merger" or "interposer" systems, and the like, as disclosed, for example, in U.S. Pat. No. 4,579,446 to Fujino, et al.; U.S. Pat. No. 4,587,532 to Asano; U.S. Pat. No. 5,489,969 to Soler, et al.; U.S. Pat. No. 5,568,246 to Keller, et al.; U.S. Pat. No. 5,570,172 to Acquaviva; U.S. Pat. No. 5,596,416 to Barry, et al.; U.S. Pat. No. 5,995,721 to Rourke, et al.; U.S. Pat. No. 6,554,276 to Jackson, et al., U.S. Pat. No. 6,654,136 to Shimida; and U.S. Pat. No. 6,607,320 to Bobrow, et al., the disclosures of all of these references being incorporated herein by reference.

A typical parallel printing system is one which feeds paper from a common paper stream to a plurality of printers, which may be horizontally and/or vertically stacked. Printed media from the various printers is then conveyed from the printers to a common finisher where the sheets associated with a single print job are assembled.

Figure 2:
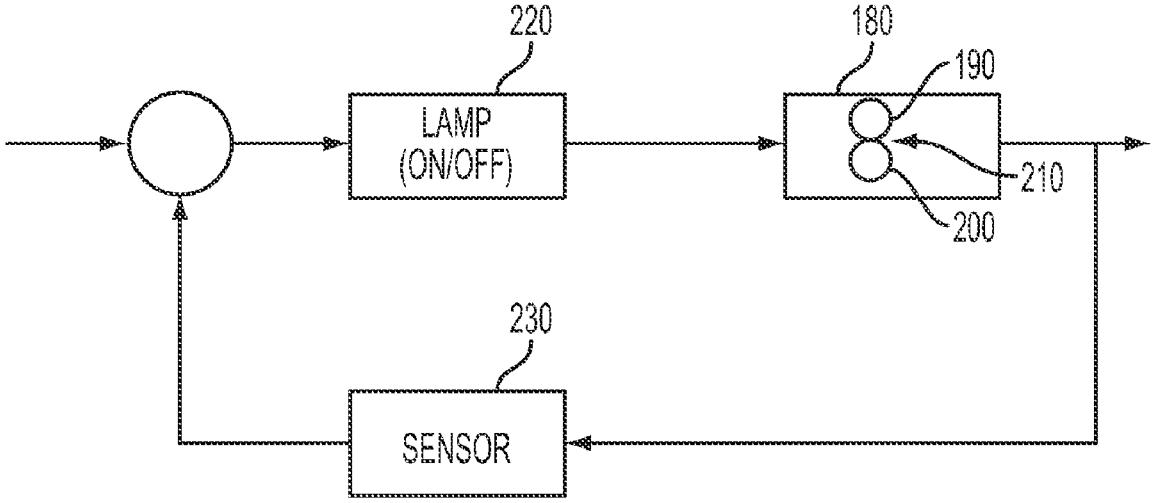
FIG. 2 is a schematic diagram of a conventional fusing system.

The print engine 130 further includes a fuser (or fusing system) 180, which is illustrated schematically in FIG. 2. By way of background, the typical xerographic imaging process is initiated by charging a photoconductive member to a uniform potential. An electrostatic latent image, corresponding with a print job, is then selectively discharged on the surface of the photoconductive member. A developer material is then brought into contact with the surface of the photoconductor to transform the latent image into a visible reproduction. The developer material includes toner particles with an electrical polarity opposite that of the photoconductive member, causing them to be naturally drawn to it. A blank media sheet is brought into contact with the photoreceptor and the toner particles are transferred to the sheet by the electrostatic charge of the media sheet. The toned or developed image is permanently affixed to the media sheet by subsequent application of heat to the sheet. The photoconductive member is then cleaned to remove any charge and/or residual developing material from its surface to prepare the photoconductive member for subsequent imaging cycles.

One preferred fusing method is to provide a heated fuser roll 190 in pressure contact with a back-up roll or biased web member 200 to form a nip 210. A print media sheet is passed through the nip 210 to fix or fuse the toner powder image on the sheet. In one common example, the heated roll is heated by applying power to a heating element such as a lamp 220 located internally within the fuser roll that extends the width of the fuser roll. The heat from the lamp 220 is transferred to the fuser roll surface along the fusing area. Quartz lamps have been preferred for the heating element. The fusing system 180 may also incorporate one or more temperature sensors, referred to generally at 230.

Figure 3:
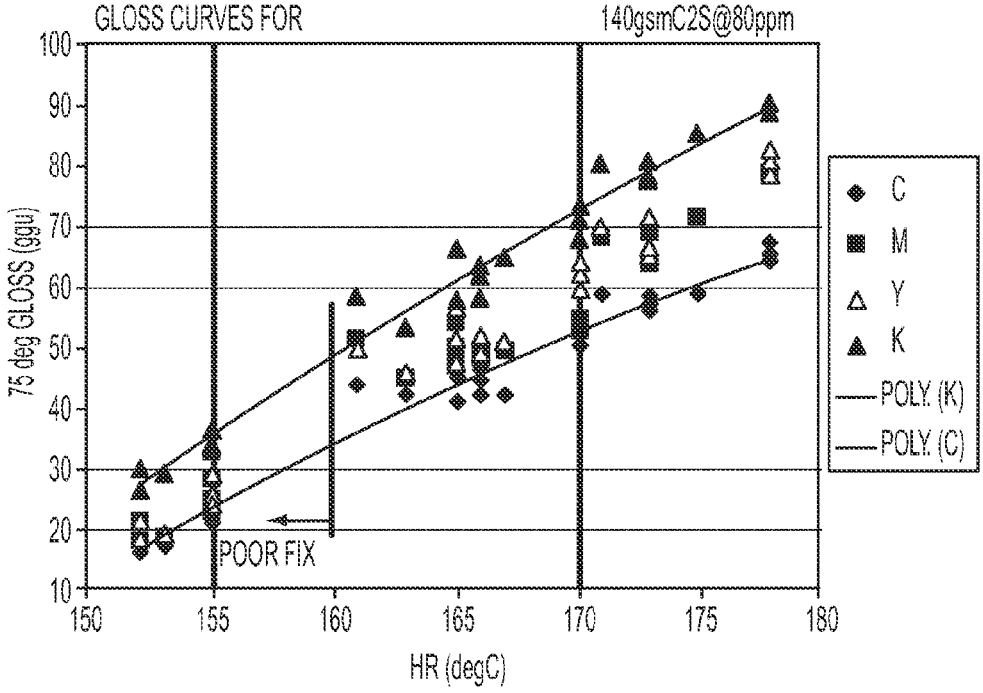
FIG. 3 is an example of gloss curves.

By way of example, let us assume that the print engine 130 operates at gloss levels ranging from 45 to 90 ggu, with acceptable fix levels as shown in FIG. 3. The print engine 130 operates at a HR (heated roller) temperature that is set based on media weight ranges (coated or uncoated). The HR temperature is set high enough so that the gloss saturates above ~90 ggu. This is acceptable for customers who like glossy prints, but some customers prefer lower gloss levels.

As disclosed herein, it is now possible for the customer to be able to dial-in a desired gloss level and have the fuser set its heat roll temperature to control the gloss to the desired level. Other possible actuators include: pressure/load, oil rate, fuser speed and TMA, but temperature will be used to explain the concept herein. A gloss vs. temperature look-up table based on the media library could help dial-in a desired gloss objective, but gloss can vary in the order of 15 ggu, for example, even using that look-up table. This variation is due to changes in uncontrolled or poorly controlled factors, including variations in paper properties; toner properties and TMA; oil levels; fuser roll age; dwell time and temperature variability.

Figure 4:
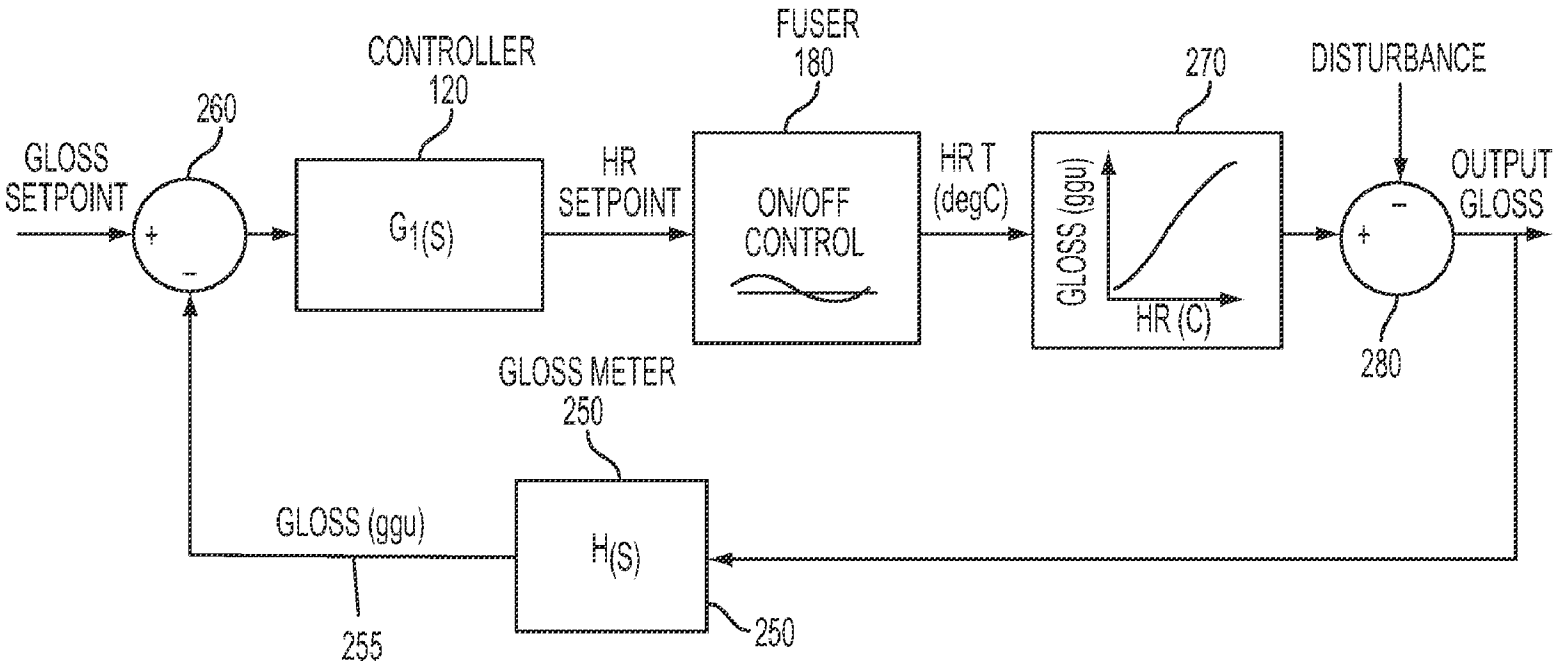
FIG. 4 is a block diagram of a fuser gloss feedback control system.

We turn now to FIG. 4, which shows a fuser gloss feedback control block diagram. The fuser 180 is provided with gloss feedback control via an in-line gloss meter 250. The on-line gloss meter 250 will be synched to the paper and measure image gloss. The gloss level will be used as a feedback signal 255 to control the fuser roll temperature in order to maintain a customer desired gloss level.

To achieve repeatable gloss a feedback control is required. To accomplish this, the on-line gloss meter 250 will measure image gloss as the paper exits the fuser. Only the image gloss measurements are used as feedback as explained further on. For this, the gloss measurements will be synched with the pages. A suitable gloss meter would be the Zehntner ZOL 1190, which can measure 1000 samples/second with an accuracy of about 0.5 ggu, although other types of meters may be used.

The current gloss level is compared to the desired gloss level and an error is measured at 260. This error will be the input to the controller 120 that will adjust the heat roll set-point temperature in a dynamic manner in order to reduce the error to a minimum quantity. The controller 120 can be designed in order to allow the fuser 180 to adjust in either an abrupt or smooth manner.

The controller 120 will adjust the HR set-point temperature, and, as a result, the fuser ON/OFF control 180 will either increase or decrease the fuser temperature. Further, the fused image gloss level will go up or down with the HR temperature as per the gloss curve 270. There will always exist a disturbance 280 that will affect the final gloss level. Because of this disturbance an open-loop control is not effective since it will make the gloss vary significantly. So a closed-loop feedback control is required in order to correct HR set-point temperature. This is done with the use of feedback 255 in combination with the gloss level measured error 260 and the controller 120.

Figure 5:
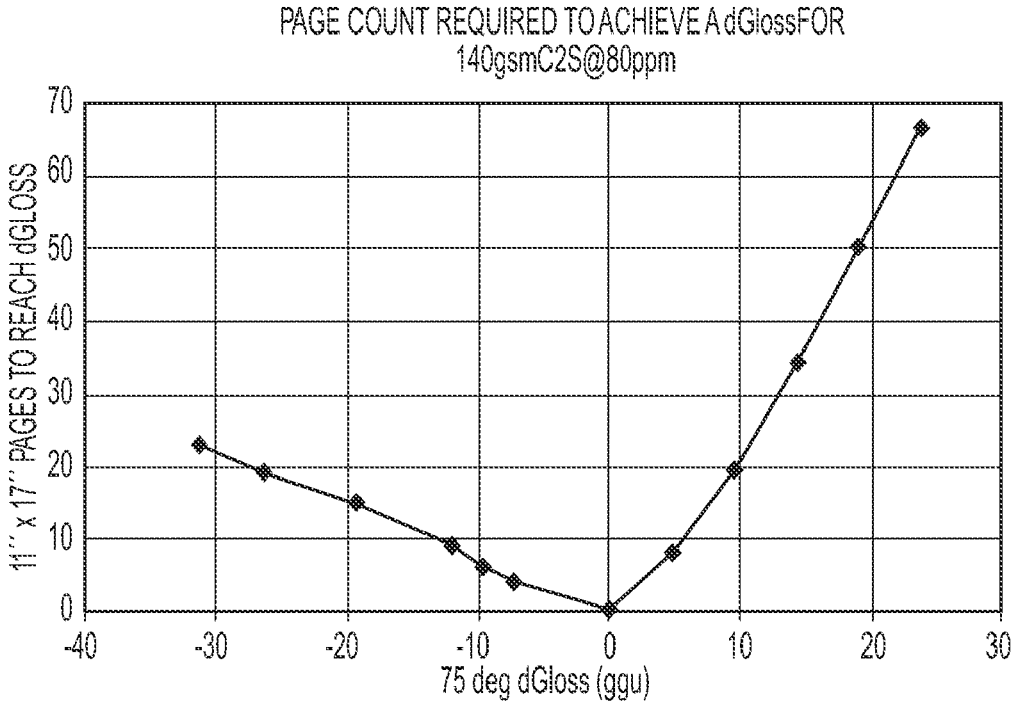
FIG. 5 is an example on the number of pages required to increase or decrease gloss by a given amount while printing.
Figure 6:
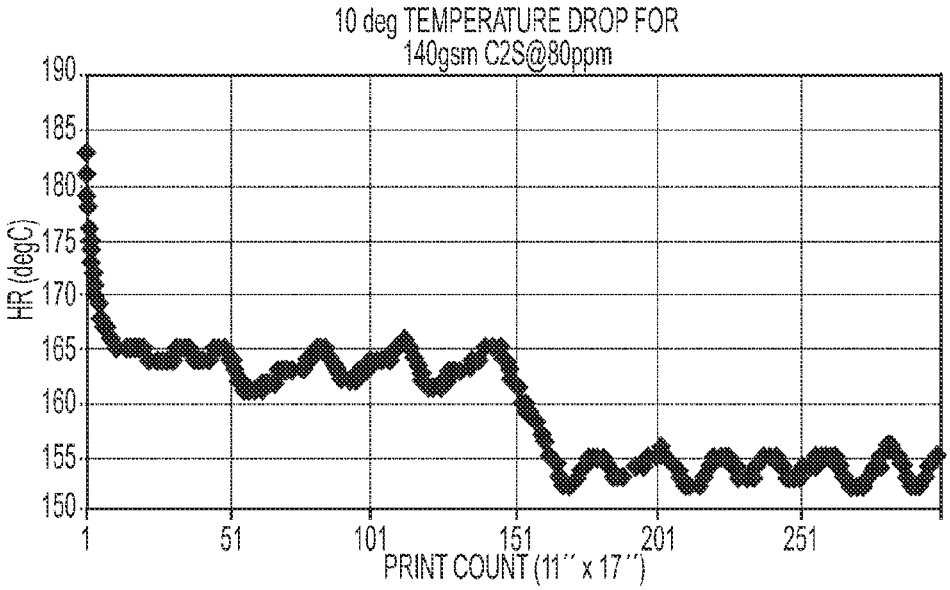
FIG. 6 is an example of a fuser dropping 10 deg C. in fuser roll temperature.
Figure 7:
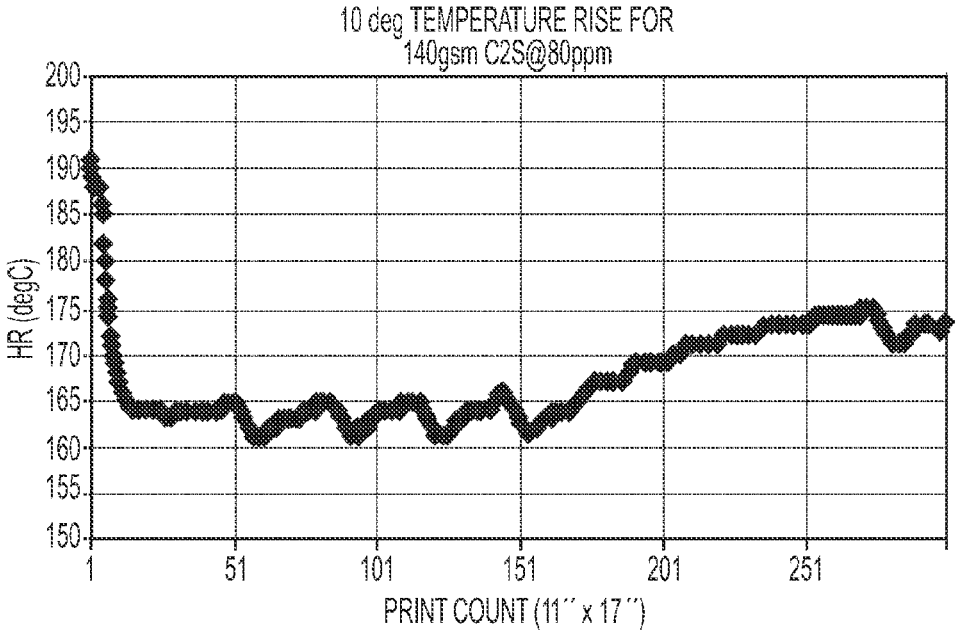
FIG. 7 is an example of a fuser rising 10 deg C. in fuser roll temperature.

The control scheme has two stages—a learning stage and a control stage. In the learning stage a look-up table is created. The look-up table can be factory or customer set for any media by running a preset job and letting the fuser 180 control its steady-state temperature within a temperature range to create its corresponding gloss look-up table. The temperature range will be limited to the range in which the toner is appropriately fixed to the media. The temperature upper limit will be limited by hot offset, and the temperature lower limit is limited by poor fix and/or cold offset. The look-up table is then used by the controller 120 as a first reference. The look-up table is necessary in order to avoid big gloss transitions that require large amounts of time. For example, if someone wants a 60 ggu gloss and the fuser 180 is set at 90 ggu, then a 30 ggu drop is required. This drop corresponds to about 15 degrees C., which takes about 25 11"×17" sheets (140 gsmC2S@80 ppm), as shown in FIGS. 5-7. In the event that a change from 60 to 90 ggu is required, it will take the fuser about 100 11"×17" (140 gsmC2S@80 ppm) sheets to change its setting as shown in FIGS. 5-7.

The control part will be during costumer jobs where the gloss level is controlled with the aid of the expected gloss range. For example, if the customer wants a gloss level of 60 ggu for black, then the expected gloss range might be 40-65 ggu. If the gloss measured goes above the range, then the fuser 180 will lower its temperature. But if the gloss goes below the range the fuser 180 will increase its temperature. The fuser 180 may require controlling gloss changes in the order of 15 ggu for which it will require about 35 pages (11"×7") to increase the gloss and 10 pages (11"×17") to decrease it in the case of a sudden change, as shown in FIG. 5. However, these changes generally occur with considerably longer time constants that will let the controller 120 adjust to these changes in a more gradual manner. The controller 120 determines the frequency and amount of temperature target correction. The controller 120 will also take into consideration area coverage as another input in its control algorithm. The controller 120 can wait for a specified number of pages to be outside the expected gloss range before making an adjustment. This will prevent the controller 120 from adjusting the heat roll set-point temperature too frequently which can cause other undesired effects. Also, the controller 120 needs to take into consideration area coverage, since when low area coverage is present the gloss meter 250 will also have the substrate gloss in its measurement. Since the main goal is to control the fused image gloss, the controller 120 could only use the gloss of the high area coverage images to control the desired gloss level. The controller 120 can potentially also discern between the substrate and the fused image gloss level and adjust the HR set-point temperature in order to match them both.

Figure 8:
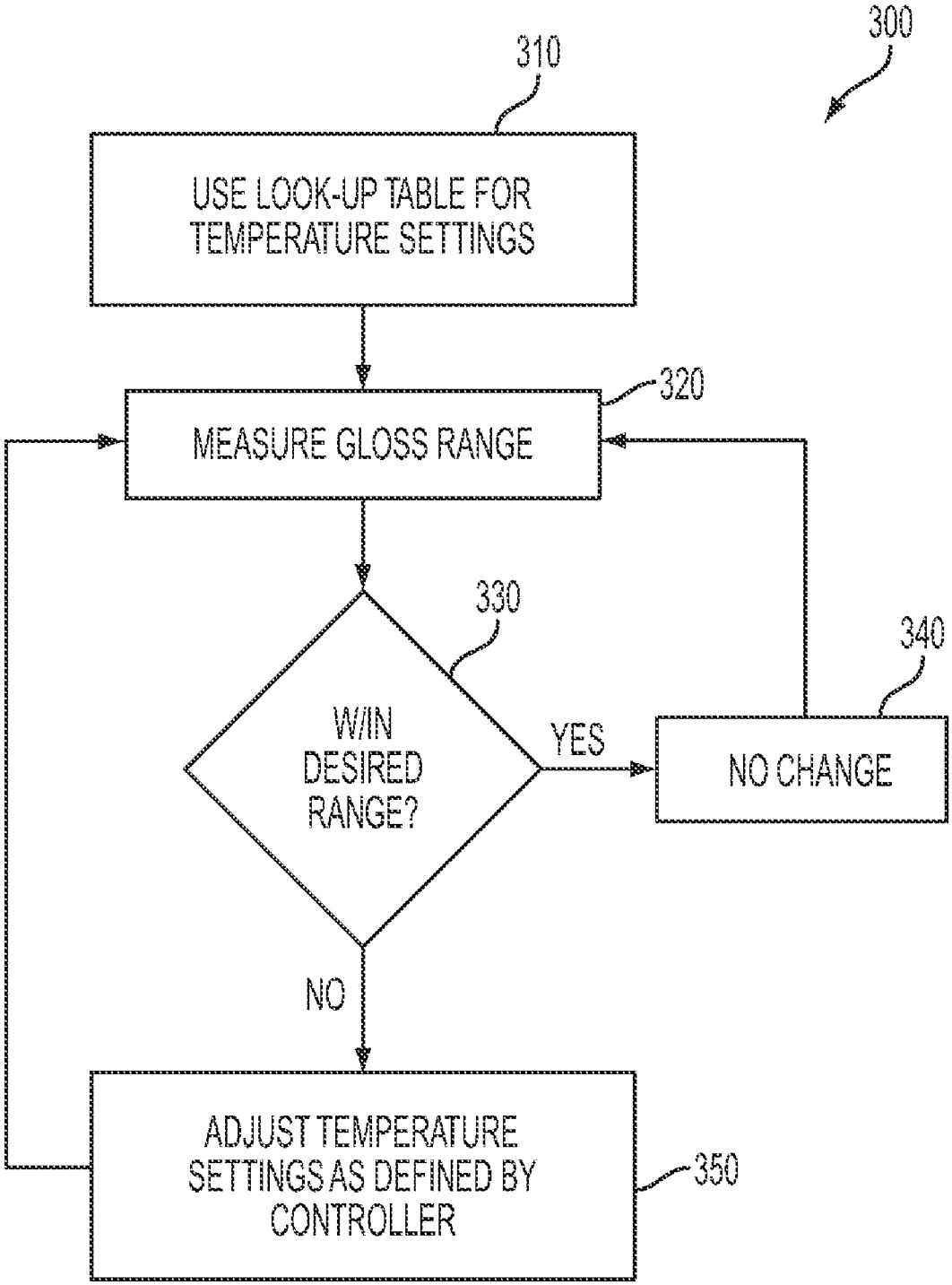
FIG. 8 is a flow chart of an exemplary method of fusing prints with gloss feedback control.

More particularly, a flowchart of an exemplary method 300 for gloss feedback control is outlined in FIG. 8. In this example it is presumed that the learning stage has already been performed and that a gloss look-up table has been established. Initially, use the look-up table for temperature settings (310). Next, measure the gloss range on a continuously with the gloss meter 250 (320), and determine whether it is within the desired range (330). If it is within the desired range, then there is no change required (340). Otherwise, the temperature settings of the fuser 120 are adjusted as defined by the controller 120 (350).

As an additional concept it is possible to use this feedback control to match image to substrate gloss by measuring substrate gloss (with the same on-line sensor that is measuring image gloss) where there is no image. This substrate gloss measurement will be used by the controller as a reference to set output gloss.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of controlling gloss in a printing system having a fuser, the method comprising:

creating a gloss look-up table for temperature settings;

using the look-up table for temperature settings to determine a desired gloss range;

measuring an actual gloss range of a high toner coverage area and a low toner coverage area on a sheet continuously as the sheet exits the fuser with an in-line gloss meter synched to the sheet;

determining whether the actual gloss range of the high toner coverage area is within the desired gloss range and using the actual gloss range of the high toner coverage area as a feedback signal to control a temperature setting of the fuser; and where the actual gloss range of the high toner coverage area is outside the desired gloss range for a pre-defined number of sheets, dynamically adjusting temperature settings of the fuser.

2. The method of claim 1, further comprising:

running a preset job and letting the fuser control its steady-state temperature within a temperature range having an upper limit and a lower limit to create the gloss look-up table.

3. The method of claim 1, wherein the temperature range is limited to the range in which toner is appropriately fixed to media.

4. The method of claim 1, wherein the temperature upper limit is limited by hot offset.

5. The method of claim 1, wherein the temperature lower is limited by poor fix and cold offset.

6. The method of claim 1, wherein the printing system further comprises a user interface, a digital front end controller, and at least one print engine.

7. The method of claim 1, wherein the printing system incorporates parallel print engines.

8. The method of claim 2, wherein the temperature range is limited to the range in which toner is appropriately fixed to media, the temperature upper limit is limited by hot offset, and the temperature lower limit is limited by poor fix and cold offset.

9. The method of claim 8, wherein the printing system further comprises a user interface, a digital front end controller, and at least one print engine.

10. The method of claim 9, wherein the printing system incorporates parallel print engines.

11. A printing system comprising:

a user interface for receiving operating instructions for the printing system;

at least one print engine for marking a plurality of sheets in a print job;

a fuser having a plurality of temperature settings;

a digital front end controller for controlling the operation of the printing system; and an in-line gloss meter synched to the sheets for providing continuous feedback to the digital front end controller, wherein the digital front end controller is operative to:

create a gloss look-up table for temperature settings;

use the look-up table for temperature settings to determine a desired gloss range;

receive gloss range data for a high toner coverage area and for a low toner coverage area on the sheet from the in-line gloss meter continuously as each sheet exits the fuser;

determine whether the actual gloss range of the high toner coverage area is within the desired gloss range and use the actual gloss range of the high toner coverage area as a feedback signal to control a temperature setting of the fuser; and dynamically adjust the temperature settings of the fuser where the actual gloss range of the high toner coverage area is outside the desired gloss range for a predefined number of sheets.

12. The printing system of claim 11, wherein the controller is further operative to:

run a preset job and let the fuser control its steady-state temperature within a temperature range having an upper limit and a lower limit to create a gloss look-up table.

13. The printing system of claim 11, wherein the temperature range is limited to the range in which toner is appropriately fixed to media.

14. The printing system of claim 11, wherein the temperature upper limit is limited by hot offset.

15. The printing system of claim 11, wherein the temperature lower limit is limited by poor fix and cold offset.

16. The printing system of claim 11, wherein the printing system further comprises a user interface, a digital front end controller, and at least one print engine.

17. The printing system of claim 11, wherein the printing system incorporates parallel print engines.

18. The printing system of claim 12, wherein the temperature range is limited to the range in which toner is appropriately fixed to media, the temperature upper limit is limited by hot offset, and the temperature lower limit is limited by poor fix and cold offset.

19. The printing system of claim 12, wherein the controller is further operative to:

measure sheet gloss where there is no image on the sheet continuously as the sheet exits the fuser with an in-line gloss meter synched to the sheet;

discern between the sheet and the fused image gloss measurements;

use the sheet gloss measurement as an additional reference to dynamically adjust the temperature settings of the fuser and set output gloss to match the sheet and the fused image gloss levels.

20. The method of claim 1, further comprising:

measuring sheet gloss where there is no image on the sheet continuously as the sheet exits the fuser with an in-line gloss meter synched to the sheet;

discerning between the sheet and the fused image gloss measurements;

using the sheet gloss measurement as an additional reference to dynamically adjust the temperature settings of the fuser and set output gloss to match the sheet and the fused image gloss levels.

* * * * *